United States Patent [19]

Mitchell

[11] Patent Number: 4,867,451

[45] Date of Patent: Sep. 19, 1989

[54] COMBINATION OF A FLEXIBLE HANDLE AND A BALL

[75] Inventor: Terrance R. Mitchell, Bellingham, Wash.

[73] Assignee: Rocketbal, Inc., Kent, Wash.

[21] Appl. No.: 177,440

[22] Filed: Apr. 1, 1988

[51] Int. Cl.[4] ..... A63B 43/02

[52] U.S. Cl. ..... 273/58 C; 273/414; 273/DIG. 20

[58] Field of Search ..... 273/58 C, 58 K, 335, 273/334, 413, 414, 428, 200 R, 199 A, DIG. 20

[56] References Cited

U.S. PATENT DOCUMENTS

| | | | |
|---|---|---|---|
| 1,921,523 | 8/1933 | Hart | 273/58 C |
| 4,657,253 | 4/1987 | Lerner et al. | 273/58 C |
| 4,696,472 | 9/1987 | Meyer | 273/58 C |

*Primary Examiner*—George J. Marlo

*Attorney, Agent, or Firm*—T. W. Secrest

[57] ABSTRACT

This invention is a toy comprising a soft and flexible ball and a handle in the configuration of a loop. The loop is soft and flexible. The loop is constructed in a manner so that the ends fold back in a first keeper adjacent a second keeper. The ends of the loop and the keepers are embedded in a recess in the ball and the loop is forced through the ball. A person can play with the ball and be hit by the ball and loop and not be hurt because of the soft and flexible material of construction.

20 Claims, 2 Drawing Sheets

COMBINATION OF A FLEXIBLE HANDLE AND A BALL

THE BACKGROUND OF THE INVENTION

This invention is a toy with which people of many ages can play.

The toy comprises a ball and a loop attached to a ball.

A baby learning to grasp an object can grasp the loop and can try and grasp the ball.

A child can hold the ball and throw the ball or can hold the handle and throw the ball and the handle.

Young people in an open area can play catch with the toy and can throw it back and forth to each other. Also, they can use the toy like a slingshot by holding onto the ball and pulling the ball to stretch the loop or the handle. Upon letting go of the ball the loop or handle will pull the ball forward so as to fly through the air.

An adult and a young child can play with the toy by tossing it back and forth.

THE GENERAL DISCRIPTION OF THE INVENTION

The ball is made of a soft material. The handle is also made of a soft material and is formed in the configuration of a loop. The handle and the ball are united to each other and are made integral.

The toy upon hitting another person or striking another person will not hurt as the ball is soft and yeilds and also the handle is soft and flexible and yields.

THE DRAWINGS

In the drawings it is seen:

THE SPECIFIC DESCRIPTION OF THE INVENTION

Figure 1:
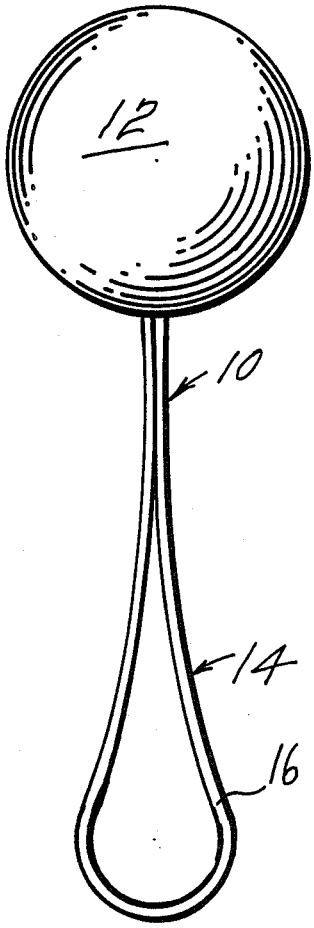
FIG. 1 is an illustration of the toy comprising a mass of material in the configuration of a ball and a handle in the configuration of a loop.
Figure 2:
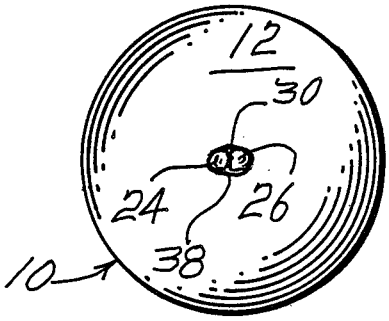
FIG. 2 is a first end view of the toy showing the mass of material and part of the handle in the mass of material.
Figure 4:
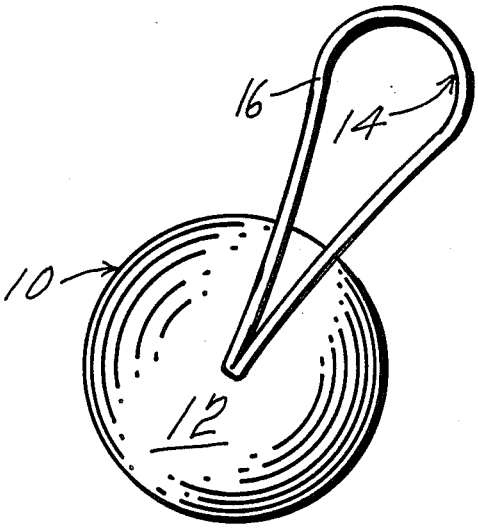
FIG. 4 is a perspective view of the mass of material and the handle in the configuration of a loop.
Figure 3:
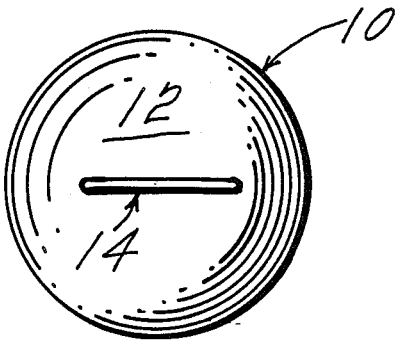
FIG. 3 is a second end view of the toy and shows the loop portion of the handle against the background of the material.

In the drawings it is seen that there is a toy 10 comprising a combination of a mass of material 12 in the configuration of a ball or a spheroid and a flexible handle 14. Said mass 12 is of a soft plastic such as rubber, polyurethane, polyvinyl chloride and the like. It is resilient, resistant to abrasion and yielding upon striking an object. The handle 14 is also of a soft plastic such as rubber, polyurethane, polyvinyle chloride and is resilient, resistant to abrasion, flexible and yielding. The handle 14 may be of tubular material or may be of a solid material. The handle is of such a quality that upon striking a person it will not hurt the person and upon striking an object it will yield.

Figure 5:
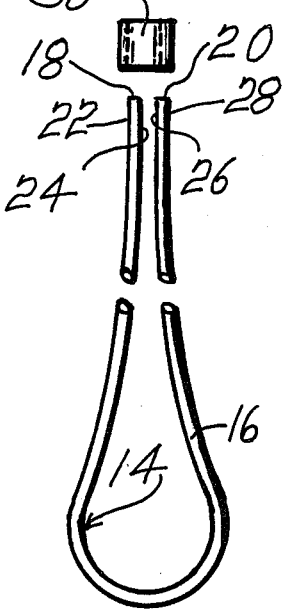
FIG. 5 is an exploded view of the handle in the configuration of the loop and a first keeper.
Figure 6:
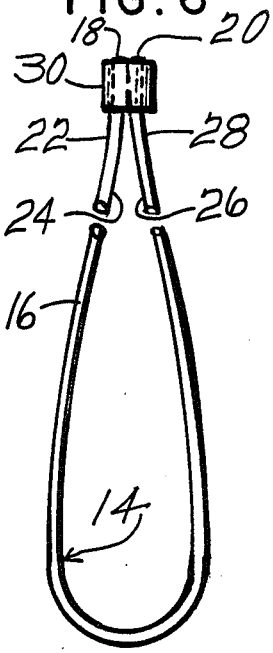
FIG. 6 is a view showing the combination of the handle in the configuration of a loop and the first keeper with the first keeper forcing together the loop near the first end and the second end of the flexible handle and with the ends of the flexible handle pointing upward.
Figure 7:
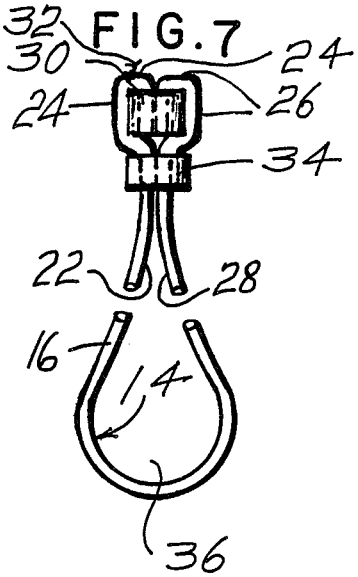
FIG. 7 is a side elevational view of the completed handle with the ends of the loop pointed downwardly and also the handle looping back on the end portions and directed towards the loop portion and illustrating the first keeper at the ends of the downwardly directed handle and a second keeper below the first keeper and on the looped part of the handle.

In FIGS. 5,6 and 7 there is illustrated the construction of the flexible handle 14. The handle 14 is made of a length 16 of flexible material. The length 16 has a first end 18 and a second end 20. In FIG. 5 it is seen that the first end 18 has a first outer surface 22 and a second inner surface 24. The second end 20 has a third inner surface 26 and a fourth outer surface 28. There is a first keeper 30. In FIG. 5 the length 16 and the keeper 30 are separated.

In FIG. 6 the keeper 30 is positioned over the ends 18 and 20 of the length 16. The keeper 30 can be of a plastic such as rubber or polyurethane or other suitable plastic which can be expanded upon stretching. The keeper 30 is in the configuration of a short tube or an O-ring. The keeper 30 can be expanded and positioned over the ends 18 and 20 of the length 16. Upon contracting the keeper 30 will force together the second inner surface 24 of the first end 18 and the third inner surface 26 of the second end 20 as illustrated in FIG. 6.

In FIG. 7 there is illustrated the folding back of the ends upon the adjacent part of the length 16 to form the united end 22. In FIG. 7 it is seen that the ends 18 and 20 are directed to the loop 36 of the flexible handle 14 or the ends 18 and 20 are directed downwardly. The second inner surface 24 and the third inner surface 26 are adjacent to each other and on the upper part become an outer surface and then fold back and are directed downwardly so that the former first outer surface 22 is adjacent to and bearing against the outside of the first keeper 30 and the former fourth outer surface 28 is adjacent to and bearing against the outer surface of the first keeper 30. Then, the second keeper 34 is expanded. The second keeper 34 can be of plastic such as rubber or polyurethane or other suitable plastic and is in the configuration of a short tube or an O-ring. The second keeper 34 can be expanded and passed over the first keeper 30 and on the outside of the second inner surface 24 and the third inner surface 26 and then allowed to contract so as to force together, below the first keeper 30, the length 16 of flexible material. At this position the former first outer surface 22 and the former fourth outer surface 28 are bearing against each other. The length 16 has now been formed into a loop 36 as illustrated in FIG. 7. The second keeper 34 is positioned between the first keeper 30 and the loop 36.

Figure 8:
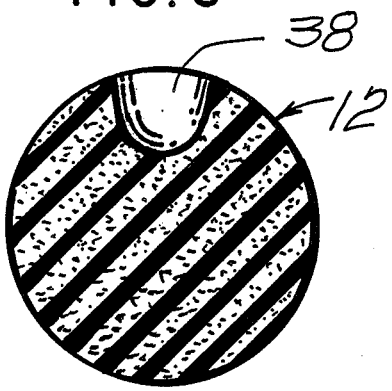
FIG. 8 is a cross-sectional view of the ball showing the recess for receiving the united end of the flexible handle.

In FIG. 8 there is a cross sectional view of the mass 12 in the configuration of a spheriod and there is illustrated a recess 38 in the mass 12.

Figure 9:
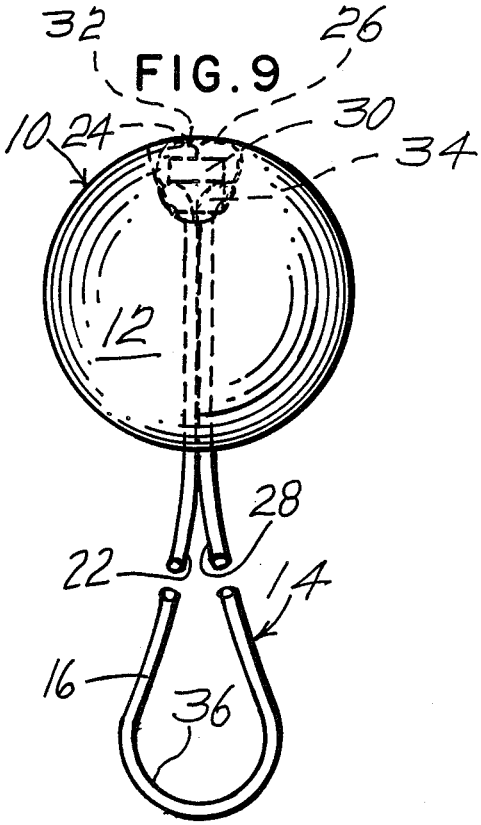
FIG. 9 shows the toy as a combination of the mass of material in the configuration of a spheroid and a flexible handle with the end of the handle in the recess of the ball and also the loop portion of the handle extending through the ball and on the outside of the ball.

In FIG. 9 there is illustrated a toy 10 comprising a combination of the mass 12 and the handle 14. The united end 32 with the handle 14 is positioned in the recess 38 of the mass 12. The loop 36 of the handle 14 has been forced through the majority of the mass 12 as illustrated in FIG. 9. The second keeper 34, the first keeper 30 and the ends 18 and 20 are positioned in the recess 38 in the mass 12.

With the toy 10 a person can hold onto the flexible handle and throw the toy. The person can see how far the toy can be thrown. Also, there may be another person to try and catch the toy by either by the handle 14 or the mass 12.

The toy 10 can be used like a slingshot. A person can hold the flexible handle in one hand and pull on the ball with the other hand. Then, the person can let go of the ball and see how far the toy 10 will travel through the air. A contest can be made to see how far the person can make the ball travel through the air with this slingshot effect.

The mass 12 and the flexible handle 14 are soft and nonabrasive and, if a person is hit with the toy 10, the person will not be hurt. This is important from the stand point of a little child whose coordination may not be sufficiently good to catch the toy 10 as it is traveling through the air. If the toy hits the child on the head or the body the child will not be hurt.

Another feature is that the mass 12 is of sufficiently large diameter that a baby or a child can not put the mass 12 inside the mouth and possibly be hurt.

The loop 36 is a flexible handle 12 and has a sufficiently small opening that it cannot be placed over the head of a baby or a child so as to possibly hurt the baby or the child.

In the preparation of this patent application a patent search was not made. The inventor knows that there have been combinations of balls and handles. The inventor does not know of a combination of a ball and a handle made according to this invention.

The invention is useful as people of various ages can use the toy 10 for play. The various people can throw the toy back and forth to each other so as to be caught. Also, a game can be perfected with this toy to see how far a person can throw the toy or how far a person can shoot the toy in a slingshot effect.

From the foregoing it is seen that I have provided a combination of a mass and a handle with said handle being in the configuration of a loop; part of said handle being in said mass; said handle comprising a length of material having a first end and a second end; said first end and said second end being juxtapositioned; said first end and said second end having a first outer surface and a second inner surface; said second end having a third inner surface and a fourth outer surface; a first keeper encircling said first end and said second end and being on the outside of said first surface and said second surface; said first end, said second end, said first keeper and said length of material forming said loop; said first end and said second end being directed toward said loop; said first end folding back on itself with said first surface adjacent to said first keeper; said second end folding back on to itself with said first surface adjacent to said first keeper; a second keeper encircling said length of material near said first keeper and between said first keeper and said loop; said second keeper being on the outside of said second surface and said third surface with said first surface and said fourth surface being juxtapositioned; said first end, said second end, said first keeper, said second keeper and part of the lenghth of the material being in said mass and said length being outside of said mass; said mass being flexible and having a yielding quality so that upon striking an object the mass yields; said handle being of a flexible, yielding and stretchable material so that upon striking an object the handle yields, said mass being in the configuration of a spheroid; said mass having a recess for receiving part of said handle; said first end, said second end, said first keeper and said second keeper being in said recess; and, said mass and said handle being of plastic.

Also, I have provided a method for making a combination of a mass and a handle, said method comprising selecting said handle of a length of material having a first end and a second end; juxtapositioning said first end and said second end with said first end having a first outer surface and a second inner surface and said second end having a third inner surface and a fourth outer surface; positioning a first keeper to encircle said first end and said second end on the outside of said first surface and said fourth surface to form with said length of material a loop; directing said first end and said second end toward said loop; folding said first end back on itself with said fourth surface being adjacent to said first keeper; positioning a second keeper to encircle said length of material near said first keeper and between said first keeper and said loop with said third surface with said first surface and said fourth surface being juxtapositioned; positioning substantially all of said first end, said second end, said first keeper and said second keeper and part of the length of said material in said mass said material outside of said mass; said mass being flexible and having a yielding quality so that upon striking an object the mass yields; said handle being of a flexible, yielding and stretchable material so that upon striking an object the handle yeilds; selecting said mass in the configuration of a spheriod; forming a recess in said mass for receiving part of said handle; positioning substantially all of said first end, said second end, said first keeper and said second keeper in said recess; positioning the majority of said length of material of said handle outside of said mass; and said mass and said handle being of plastic.

Further, it is seen that I have provided a combination of a mass and a handle made by a method comprising selecting said handle of a length of material having a first end and a second end; juxtapositioning said first end and said second end with said first end having a first outer surface and a second innner surface and a said second end having a third inner surface and a fourth outer surface; positioning a first keeper to encircle said first end and said second end on the outside of said first surface and said fourth surface to form with said length of material a loop; directing said first end and said second end toward said loop; folding said first end back on itself with said first surface being adjacent to said first keeper; folding said second end back on itself with said fourth surface being adjacent to said first keeper; positioning a second keeper to encircle said length of material near said first keeper and between said first keeper and said loop with said second keeper being on the outside of said second surface and said third surface with said first surface and said fourth surface being juxapositioned; positioning substantially all of said first end, said second end, said first keeper and said second keeper and part of the length of said material of said material in said mass and part of the length of said material outside of said mass; selecting said mass in the configuration of a spheroid; forming a recess in said mass for receiving part of said handle; positioning substantially all of said first end, said second end, said first keeper and said second keeper in said recess; postioning the majority of said length of material of said handle outside of said mass; and, said mass and said handle being of plastic.

It is seen in the foregoing disclosure that I have provided a toy comprising a ball and a handle; a method for making said toy; and, a toy made by the method.

What I claim as my invention is:

1. A combination of a mass and a handle:
a. said handle being in the configuration of a loop;
b. part of said handle being in said mass;
c. said handle comprising a length of material having a first end and a second end;
d. said first end and said second end being juxtapositioned;
e. said first end having a first outer surface and a second inner surface;
f. said second end having a third inner surface and a fourth outer surface;
g. a first keeper encircling said first end and said second end and and being on the outside of said first outer surface and said fourth outer surface;
h. said first end, said second end, said first keeper and said length of material forming said loop;
i. said first end and said second end being directed toward said loop;
j. said first end folding back on itself with said first surface being inside of said first keeper and also adjacent to the outer surface of said first keeper;
k. said second end folding back on itself with said fourth surface being inside said keeper and also adjacent to said first keeper;
l. a second keeper encircling said length of material near said first keeper and between said first keeper and said loop;
m. said second keeper being on the outside of said second surface and said third surface with said first surface and said fourth surface being juxtapositioned; and,
n. said first end, said second end, said first keeper, said second keeper and part of the length of the material being in said mass and part of said length being outside of said mass.

2. A combination according to claim 1 and comprising:
a. said mass being flexible and having a yielding quality so that upon striking an object the mass yields;
b. said handle being of a flexible, yielding and stretchable material so that upon striking an object the handle yields.

3. A combination according to claim 2 and comprising:
a. said mass being in the configuration of a spheroid;
b. said mass having a recess for receiving part of said handle;
c. said first end, said second end, said first keeper and said second keeper being in said recess; and,
d. said mass and said handle being of plastic.

4. A combination according to claim 1 and comprising:
a. said mass being in the configuration of a spheroid; and,
b. said mass having a recess for receiving part of said handle.

5. A combination according to claim 4 and comprising:
a. said first end, said second end, said first keeper and said second keeper being in said recess.

6. A combination according to claim 1 and comprising:
a. said mass and said handle being of plastic.

7. A method for making a combination of a mass and a handle, said method comprising:
a. selecting said handle of a length of material having a first end and a second end;
b. juxtapositioning said first end and said second end with said first end having a first outer surface and a second inner surface and said second end having a third inner surface and a fourth outer surface;
c. positioning a first keeper to encircle said first end and said second end on the outside of said first surface and said fourth surface to form with said length of material a loop;
d. directing said first end and said second end toward said loop;
e. folding said first end back on itself with said second surface being adjacent to said first keeper;
f. folding said second end back on itself with said third surface being adjacent to said first keeper;
g. positioning a second keeper to encircle said length of material near said first keeper and between said first first keeper and said loop with said second keeper being on the outside of said second surface and said third surface with said first surface and and said fourth surface being juxtapositioned; and,
h. positioning substantially all of said first end, said second end, said first keeper and said second keeper and part of the length of said material in said mass of material and also outside of said mass.

8. A method according to claim 7 and comprising:
a. said mass being flexible and having a yielding quality so that upon striking an object the mass yields;
b. said handle being of a flexible, yielding and stretchable material so that upon striking an object the handle yields.

9. A method according to claim 8 and comprising:
a. selecting said mass in the configuration of a spheroid;
b. forming a recess in said mass for receiving part of said handle;
c. positioning substantially all of said first end, said second end, said first keeper and said second keeper in said recess;
d. positioning the majority of said length of material of said handle outside of said mass; and,
e. said mass and said handle being of plastic.

10. A method according to claim 7 and comprising:
a. selecting said mass in the configuration of a spheroid; and,
b. forming a recess in said mass for receiving part of said handle.

11. A method according to claim 10 and comprising:
a. positioning substantially all of said first end, said second end, said first keeper and said second keeper in said recess.

12. A method according to claim 10 and comprising:
a. positioning the majority of said length of material of said handle outside of said mass.

13. A method according to claim 7 and comprising:
a. said mass and said handle being of plastic.

14. A combination of a mass and a handle made by a method comprising:
a. selecting said handle of a length of material having a first end and a second end;
b. juxtapositioning said first end and said second end with said first end having a first outer surface and a second inner surface and said second end having a third inner surface and a fourth outer surface;

c. positioning a first keeper to encircle said first end and said second end on the outside of said first surface and said fourth surface to form with said length of material a loop;

d. directing said first end and said second end toward said loop;

e. folding said first end back on itself with said second surface being adjacent to said first keeper;

f. folding said second end back on itself with said fourth surface being adjacent to said first keeper;

g. positioning a second keeper to encircle said length of material near said first keeper and between said first first keeper and said loop with said second keeper being on the outside of said second surface and said third surface with said first surface and said fourth surface being juxtapositioned; and, h. positioning substantially all of said first end, said second end, said first keeper and said second keeper and part of the length of said material in said mass and part of the length of said material outside of said mass.

15. A combination according to claim 14 and comprising:

a. said mass being flexible and having a yielding quality so that upon striking an object the mass yields;

b. said handle being of a flexible, yielding and stretchable material so that upon striking an object the handle yields.

16. A combination according to claim 14 and comprising:

a. selecting said mass in the configuration of a spheroid; and, b. forming a recess in said mass for receiving part of said handle.

17. A combination according to claim 16 and comprising:

a. positioning substantially all of said first end, said second end, said first keeper and said second keeper in said recess.

18. A combination according to claim 17 and comprising:

a. positioning the majority of said length of material of said handle outside of said mass.

19. A combination according to claim 14 and comprising:

a. said mass and said handle being of plastic.

20. A combination according to claim 14 and comprising:

a. selecting said mass in the configuration of a spheroid;

b. forming a recess in said mass for receiving part of said handle;

c. positioning substantially all of said first end, said second end, said first keeper and said second keeper in said recess;

d. positioning the majority of said length of material of said handle outside of said mass; and, e. said mass and said handle being of plastic.

* * * * *